United States Patent [19]

Bailey et al.

[11] 4,050,903

[45] Sept. 27, 1977

[54] COMBINATION MUFFLER AND CATALYTIC CONVERTER

[75] Inventors: Charles H. Bailey, Mount Prospect; James E. Dillon, Elgin, both of Ill.

[73] Assignee: UOP Inc., Des Plaines, Ill.

[21] Appl. No.: 737,129

[22] Filed: Oct. 29, 1976

[51] Int. Cl.[2] ..... F01N 3/15

[52] U.S. Cl. ..... 23/288 FC; 23/288 F; 60/299; 60/301; 423/213.2; 181/36 C; 181/259

[58] Field of Search ..... 23/288 F, 288 FC; 60/299, 301, 288; 423/212, 213.2; 181/36 C

[56] References Cited

U.S. PATENT DOCUMENTS

| | | | |
|---|---|---|---|
| 2,747,976 | 5/1956 | Houdry | 423/212.3 |
| 3,852,042 | 12/1974 | Wagner | 23/288 FC |

FOREIGN PATENT DOCUMENTS

| | | | |
|---|---|---|---|
| 98,733 | 8/1898 | Germany | 60/299 |

*Primary Examiner*—James H. Tayman, Jr.

*Attorney, Agent, or Firm*—James R. Hoatson, Jr.; Barry L. Clark; William H. Page, II

[57] ABSTRACT

Combination muffler and catalytic converter utilizes an axial flow monolithic catalytic element to treat exhaust gases from an internal combustion engine and partially reduce their sound. A perforated chamber around the catalytic element, a downstream perforated tube, and an upstream flow reversal chamber further reduce the sound. The device incorporates a venturi in the exhaust gas inlet path to add secondary air. Gas swirling and gas flow reversal structure is also provided to thoroughly mix the secondary air with the exhaust gases before the mixture is passed through a flow distribution plate and into contact with the catalytic element.

4 Claims, 6 Drawing Figures

Fig. 1
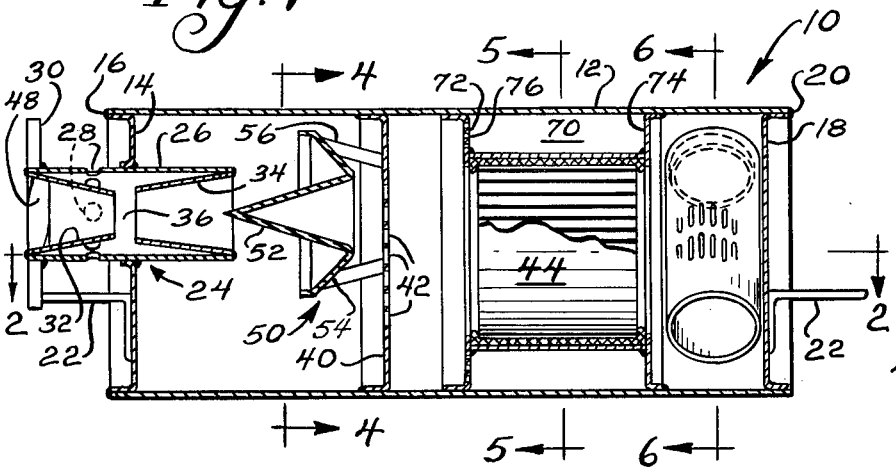
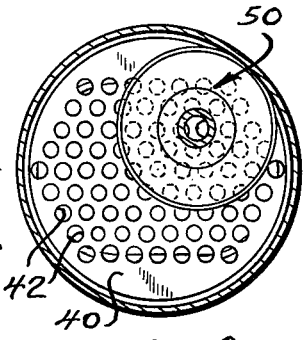
Fig. 4
Fig. 2
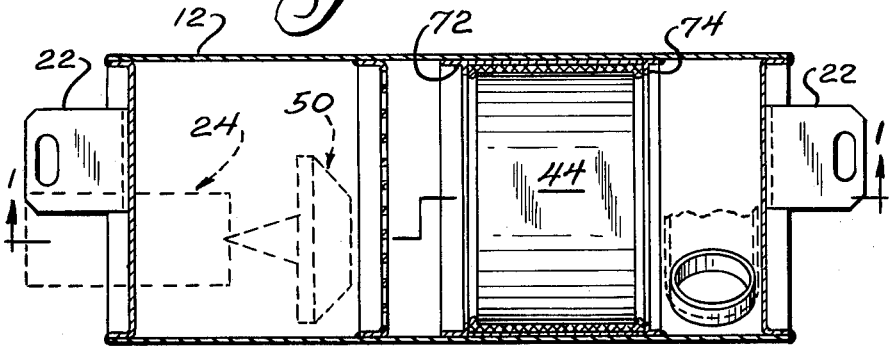
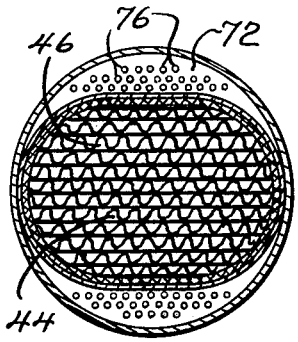
Fig. 5
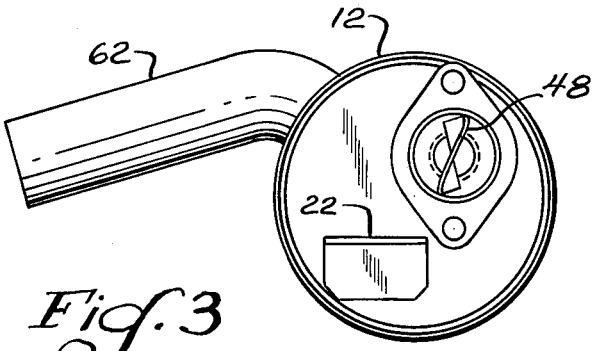
Fig. 3
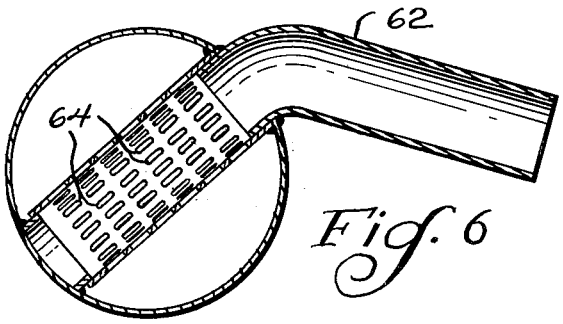
Fig. 6

COMBINATION MUFFLER AND CATALYTIC CONVERTER

BACKGROUND OF THE INVENTION

This invention relates to mufflers and particularly to mufflers which include structure for fluid treatment in addition to structure for silencing. Catalytic converters for treating automotive exhaust gases are available in a variety of configurations. Although such devices are commonly provided as a separate unit in addition to the usual muffler, it is known to provide a combined muffler and catalytic converter unit as taught by U.S. Pat. No. 3,445,196, for example.

To achieve efficient conversion of CO and HC it is necessary to provide secondary air upstream of the converter. In some instances, this air is supplied by an air pump which, of course, adds significant cost and some loss of energy. Perhaps the simplest way to add air is with a venturi. However, the amount of air drawn in by a simple venturi varies considerably as engine speed varies and is quite low at idle speeds where the mixture is usually richer and requires, proportionally, much more air than at faster speeds. This characteristic generally obviates the use of a simple venturi to add secondary air to the exhaust of an automative engine. However, where idle speeds are relatively high and running speeds are not greatly higher, such as in lift truck applications, a simple venturi could be expected to provide sufficient secondary air to achieve satisfactory conversion. It is known in the prior art to add air upstream of an ordinary converter with a venturi. In such devices, there is usually ample distance between the venturi and catalyst so that adequate mixing of the air and exhaust gases can be achieved. However, an attempt to position an exhaust inlet and venturi quite close to a catalyst element in order to achieve a compact space package resulted in a very substantial loss of conversion efficiency.

SUMMARY

It is among the objects of the present invention to provide a combination muffler and catalytic converter device that performs well as both a muffler and converter while being economical to produce and capable of being housed in a relatively small package so that it can be used as an exact replacement for an existing muffler design.

In a typical embodiment, the structure of the device is as set forth in the Abstract. The gas swirling structure is preferably a fixed propeller-like element positioned in the exhaust inlet pipe upstream of the venturi while the gas flow reversal structure comprises a deflector member which directs the flow rearwardly and outwardly of the outlet of the exhaust inlet pipe into an open chamber which is separated from the catalyst element by a flow distribution plate.

The invention has been tested and found to provide excellent results with CO conversions being increased from about 14% to about 85% for a given set of operating conditions when gas swirling and flow reversal structure was added to an identical device without this structure.

BRIEF DESCRIPTION OF THE DRAWINGS

FIG. 1 is a side sectional view of a combination muffler-converter incorporating the invention, the view being taken on line 1—1 of FIG. 2;

FIG. 2 is a top sectional view taken on line 2—2 of FIG. 1;

FIG. 3 is an end view showing the left end of the muffler-converter of FIG. 1;

FIGS. 4–6 are sectional views taken on lines 4—4, 5—5 and 6—6 of FIG. 1.

DESCRIPTION OF THE PREFERRED EMBODIMENT

Referring to FIG. 1, the combustion muffler-catalytic converter assembly indicated generally at 10 can be seen as comprising an outer metal housing or wrapper member 12 of generally cylindrical shape having an inlet bulkhead member 14 joined to its inlet end by a weld 16. Similarly, the outlet end of the assembly is closed by an outlet bulkhead member 18 welded at 20 to the housing 12. A pair of brackets 22 are attached to the assembly to facilitate its mounting to a vehicle. The exhaust gases which are to be treated by the device 10 and secondary air which must be mixed with the exhaust gases enter the device through the aspirator subassembly indicated generally at 24. The aspirator 24 includes an aspirator body 26 having a ring of holes 28 in its outer periphery and an inlet flange 30 which permits the device 10 to be rigidly mounted to the exhaust pipe (not shown) of a vehicle. The aspirator subassembly 24 further includes an inlet cone portion 32 and an outlet cone portion 34 which are separated from each other by a space 36. The cone portions 32, 34 produce a venturi effect which causes secondary air to be drawn through the holes 28 and into the exhaust stream passing through the aspirator. After the exhaust gases and secondary air are thoroughly mixed by structure which will hereinafter be described, the gas and air mixture is passed through a perforated bulkhead member 40 having a plurality of holes 42 therein which produces a backpressure on the gases and causes them to be uniformly distributed over the face of the monolithic catalyst coated element 44 which contains a plurality of axial flow channels 46.

As previously mentioned, when secondary air is drawn into an exhaust gas stream in a tube which is quite lengthy, adequate mixing of the gas and air will occur. However, space limitations require a combination muffler-converter which is to fit within the space available for a conventional muffler to have its aspirator 24 positioned quite closely to the catalytic element 44. With such close positioning, the secondary air tends not to mix with the exhaust gases but rather to remain in a layer such that the outermost axial channels 46 of the catalyst element generally receive only air while the innermost channels receive only exhaust gas. The net result, where turbulating means were not used, was extremely low conversion, in the order of 14%, since the exhaust gases were not receiving sufficient air to cause a reaction with the CO and HC in the gases. This deficiency has been cured by the addition of stationary vane 48 in the exhaust gas inlet portion of the inlet cone 32 to swirl the gases and the addition of the deflector assembly 50 comprising a cone portion 52, and a cup shaped deflector portion 54. The deflector assembly 50 is mounted by means of legs 56 to the peforated bulkhead member 40. The deflector assembly 50 causes the gases to be reversed in direction and directed backwardly toward the bulkhead 14 in the chamber surrounding the outlet cone 34. This reversal of direction causes the exhaust gas and secondary air to be thoroughly mixed before they impinge upon the perforated distribution plate or bulkhead 40. The distribution plate 40 introduces sufficient backpressure on the gases to cause them to flow uniformly through each of the holes 42 so that each of the channels 46 of the catalyst element will also see uniform flow. The even distribution of the gases results in a more efficient conversion of the CO and HC therein since no channels are overloaded. We have found that to provide maximum exhaust gas treatment in the very limited amount of axial space available, the distribution plate 40 should have at least 5 holes per square inch with the holes being uniformly spaced. It is also preferable that the holes only be placed in that portion of the plate 40 which is in axial alignment with the inlet face of the catalyst element 44. To provide sufficient backpressure for uniform distribution of the gases across the face of the catalyst element 44, the holes 42 should have an open area of about 20–40% of the open inlet face area of the catalyst element 44. to permit the gases to diffuse together after exiting the spaced apart holes in the distributor plate 40, and before impinging on the catalyst element 44, the plate 40 should be positioned at a distance from the catalyst element 44 which is at least about 5½ times the diameter of the holes 42. We have found that a hole size of 0.25 inches and an open area for the holes 42 equal to about 30% of the open face area of the catalyst element 44 is quite satisfactory.

After the exhaust gases pass through the catalyst element 44, they exit the device 10 through an outlet tube 62 which has a cylindrical perforated portion 64 positioned immediately adjacent the catalyst element 44. The perforations in the portion 64 serve to attenuate the noise of the exhaust gas and provide the desired silencing effect. Additional silencing is provided by a chamber 70 which surrounds at least portions of the catalyst element 44. The chamber 70 is defined by an inlet catalyst retaining bulkhead member 72 and an outlet catalyst retaining bulkhead member 74. A plurality of openings 76 are preferably formed in the inlet bulkhead 72 to permit exhaust gas pulses to move into and out of the chamber 70. Additional sound attenuation is provided by the myriad small channels 46 in the catalyst element as well as by the reversal of gases which takes place due to the deflector assembly 50.

Although an axial monolithic type catalyst 44 has been shown and described and is preferred, many of the advantages of the invention would also be obtained with radial flow monolithic elements or pellet bed types of elements. The maximum advantage would, however, be realized when an axial flow monolithic element is used since any deficiency in the quantity or quality of a gas entering one of the channels 46 cannot be improved upon as the gas traverses the channel whereas in a pellet bed type catalyst there is an opportunity for additional sideways diffusion after the gas enters the bed. Although a catalyst element having an oval cross-section has been shown, the particular shape used is a matter of choice and could obviously be round or some other shape. The exhaust gas inlet or aspirator body 26 is shown as being positioned off the axis of the assembly 10. Although this off-axis position was dictated by the position of an exhaust inlet pipe in an existing muffler which the present design is to exactly replace, it further illustrates the advantage of the invention in that the turbulence inducing means comprising the vane 48 and deflector assembly 50 mixes gas and air so well that there is no tendency for the gas to want to flow toward the catalyst 44 only in the area immediately surrounding the axis of the inlet.

We claim as our invention:

1. A combination muffler and catalytic converter assembly comprising an outer housing having inlet and outlet tubes therein for receiving and exhausting exhaust gases from an internal combustion engine to which the assembly is adapted to be attached; an axial flow monolithic catalytic converter element positioned within said housing and radially spaced from the walls thereof in the path of said exhaust gases; aspirator means including a plurality of openings and a venturi portion in said inlet tube for sucking secondary air through said plurality of openings and into an exhaust gas stream passing through said venturi portion of said inlet tube; a perforated distributor plate having a plurality of spaced openings defining an open area equal to 20 – 40% of the open face inlet area of the catalytic converter element, said distributor plate being positioned in said housing intermediate said aspirator means and said catalytic converter element, said perforated distributor plate containing at least 5 openings per square inch and being spaced upstream from the inlet end of said monolithic catalytic converter element by at least about 5.5 times the diameter of the openings in the distributor plate, the openings in said perforated distributor plate defining a pattern whose outer periphery generally corresponds to the outer periphery of the open inlet face area of the catalytic converter element, and turbulence inducing means positioned between said distributor plate and the inlet end of said inlet tube, said turbulence inducing means including a stationary vane member in the exhaust inlet upstream of the venturi for swirling the exhaust gases and a deflector member downstream of the venturi for reversing their flow.

2. The assembly of claim 1 wherein said inlet tube, aspirator means, vane member and deflector member are positioned in a flow path parallel to the axis of the outer housing but spaced from said axis.

3. The assembly of claim 1 wherein said outlet tube includes a perforated sound attenuation chamber portion positioned internally of said outer housing and adjacent the outlet of said catalytic converter element, all of the gases leaving said outlet tube being required to pass through the perforations defining said perforated chamber.

4. The assembly of claim 3 wherein an additional sound attenuation chamber at least partially surrounds the catalytic converter element, said additional chamber being closed at one end and perforated at the other end.

* * * * *